US006703797B2

(12) United States Patent
Chang

(10) Patent No.: US 6,703,797 B2
(45) Date of Patent: Mar. 9, 2004

(54) METHOD FOR ACTIVATING ILLUMINATOR AND ILLUMINATION DEVICE

(75) Inventor: Ching-Chung Chang, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 10/095,085

(22) Filed: Mar. 12, 2002

(65) Prior Publication Data

US 2003/0107330 A1 Jun. 12, 2003

(30) Foreign Application Priority Data

Dec. 7, 2001 (TW) ..... 90130360 A

(51) Int. Cl.[7] ..... G05F 1/00

(52) U.S. Cl. ..... 315/291; 315/224; 315/274; 315/DIG. 5

(58) Field of Search ..... 315/291, 307, 315/194, 200 R, 209 R, 224, 225, 246, 274, 276, 287, DIG. 5, DIG. 2, 360; 358/474, 475, 320, 509

(56) References Cited

U.S. PATENT DOCUMENTS 5,859,505 A * 1/1999 Bergman et al. ..... 315/307
5,907,742 A 5/1999 Johnson et al. ..... 399/51
5,932,976 A * 8/1999 Maheshwari et al. ..... 315/291
6,028,398 A * 2/2000 Kawasaki et al. ..... 315/224
6,150,773 A * 11/2000 Ribarich et al. ..... 315/291
6,188,184 B1 * 2/2001 Eberson et al. ..... 315/307
6,316,767 B1 * 11/2001 Paxton et al. ..... 250/234
6,359,387 B1 * 3/2002 Giannopoulos et al. ..... 315/46

* cited by examiner

*Primary Examiner*—Tuyet T. Vo
(74) *Attorney, Agent, or Firm*—Birch, Stewart, Kolasch & Birch, LLP

(57) ABSTRACT

A method for activating an illuminator and an illuminating device. The invention uses pins on an application specific integrated circuit (ASIC) in a scanner to output pulses of different frequencies. The illuminator has different efficiencies at different frequencies, so the heat generated by the illuminator at the frequencies of inferior efficiency is used to achieve fast warm-up, and the voltage output frequency of the highest light efficiency is provided to the illuminator after warm-up. The illumination device can be designed according to the activation method. It comprises an illuminator, a pulse output unit, a driving unit and a power supply unit. The power supply unit outputs the frequency needed for the warm-up period and the frequency needed for the working period. The driving unit activates the pulse output of the pulse output unit.

20 Claims, 5 Drawing Sheets

METHOD FOR ACTIVATING ILLUMINATOR AND ILLUMINATION DEVICE

BACKGROUND OF THE INVENTION

The invention relates to a method for activating an illuminator and an illumination device, and more particularly to a method for activating a cold cathode fluorescent lamp and illumination device utilizing the heat and light transformation effect of the cold cathode fluorescent lamp.

A light source is needed to illuminate a document to be scanned when a scanner is being operated, in order to allow the CCD (Charge Coupled Device) in the scanner to obtain image data of the document. Thus, the scanning ability of a scanner depends on the functionality of the light source.

Considering the recent trend to reduce scanner volume, the light source must also be made smaller. Therefore, the cold cathode fluorescent lamp (CCFL) is mostly used in scanners. The scanner cannot be operated until the cold cathode fluorescent lamp reaches a certain temperature; otherwise the light emitted from the fluorescent lamp is unstable. So, time must be spent to heat the cold cathode fluorescent lamp sufficiently before a scanner starts to operate. Then, the cold cathode fluorescent lamp can finally illuminate stably after warm-up time.

The life span of the cold cathode fluorescent lamp must be also taken into consideration. If the life span of the cold cathode fluorescent lamp is to be extended, the warm-up time must also be extended. This is the primary reason why the warm-up time of the cold cathode fluorescent lamps of most scanners is three minutes or so. However, most customers complain that this warm-up time is too long.

Therefore, U.S. Pat. No. 5,907,742 discloses a method for warming up the cold cathode fluorescent lamp quickly; it uses a method involving dual-voltage control. During the warm-up period, a higher input voltage (12 volts) is used; then the lower input voltage (approximately 8 volts) is used after the warm-up. The method disclosed in this patent can lower the warm-up time of the cold cathode fluorescent lamp to approximately 10–30 seconds. However, the method of this patent involves a quick warm-up through a higher voltage at the start of the warm-up, which also means that the cold cathode fluorescent lamp must bear a higher current during the warm-up period. This reduces the life of the cold cathode fluorescent lamp, which will be clarified in the following description.

Please refer to FIG. 1, which shows the life curve of the cold cathode fluorescent lamp at different currents. At higher currents, its life is much shorter. As an example, if it lights 15,000 hours continuously at currents of 5 mA and 10 mA, the life of the lamp at 10 mA is 10% shorter than the one at 5 mA. This is the first deficiency of the patent. Furthermore, the patent uses a pulse width modulation (PWM) control circuit to control input voltage for attaining two different input voltages (warm-up period and working period), which makes the design of circuit more complex. Finally, the patent uses a built-in frequency oscillator. Its oscillating frequencies float at different voltages and temperatures, and an unstable light emission occurs between 35 and 45 kHz, influencing scanning ability.

Another method of rapid illumination is to install an additional electric heating wire outside of the cold cathode fluorescent lamp. This method involves winding the electric wire around the cold cathode fluorescent lamp, utilizing the heat of the electric heating wire outside of the lamp to quickly increase the temperature of the lamp. Although this method can attain fast warm-up, a few steps in the manufacturing process must be added to the electric heating wire installment outside of the lamp. Besides, the wire installment increases expenses in furnishing and electricity. Among these deficiencies, the most serious is that the electric heating wire outside of the lamp may block light coming from the lamp, making the illumination of the lamp uneven, which also influences scanning ability.

Therefore, the present fast warm-up methods for cold cathode fluorescent lamps have certain limits and deficiencies. So, how to warm-up the lamp quickly, extend the life span of the lamp, and most importantly emit stable light, has become a very important research topic on the scanning application of the cold cathode fluorescent lamp.

SUMMARY OF THE INVENTION

The objective of the invention is to provide a method for activating an illuminator and illumination device, enabling the illuminator to illuminate fast and emit stable light.

The invention uses pins on an application specific integrated circuit (ASIC) in a scanner to output pulses of different frequencies. The illuminator has different efficiencies at different frequencies, so the heat generated by the illuminator at the frequencies of inferior efficiency is used to attain the fast warm-up.

The method of the invention uses a fixed voltage as a voltage of the illuminator, and includes the following steps. Firstly, measure the curve of light efficiency response and frequencies of the illuminator to decide the best light emitting frequency, the best warm-up frequencies and required warm-up time. Secondly, provide a dual-frequency control unit to control the output frequencies of the voltage. When operating the illuminator, the voltage at the best warm-up frequency of the illuminator mentioned above is provided; and after warm-up time, the dual-frequency control circuit is used to provide the voltage source of the best light emitting frequency mentioned above.

The best light emitting frequency and the best warm-up frequency can be obtained from the light efficiency curve of measured frequencies. The frequency at the highest light efficiency is the best light emitting frequency, and the frequency at little lower light efficiency can be chosen as the best warm-up frequency. The warm-up time can be obtained by calculating the time needed for the energy output from the voltage source to be transferred to the heat required to warm-up the illuminator according to the light efficiency of the best warm-up frequency. In practice, the best warm-up frequency is 30 kHz and the best light emitting frequency is 60 kHz. However, the best warm-up frequency and the best light emitting frequency are different for illuminators with different lamp lengths and radii. Therefore, the best warm-up frequency and the best light emitting frequency can be found by experimenting with different lamp lengths and radii.

A warm-up frequency control command is delivered to the voltage source after the dual-frequency control unit receives an activating signal, and then the voltage of the best warm-up frequency is sent out from the voltage source. A working frequency control command is delivered to the voltage source from the dual-frequency control unit after the warm-up time is up, and the voltage of the best light emitting frequency is sent out from the voltage source.

The invention further provides a light emitting device, which includes a light emitter utilized to receive an output voltage in order to emit light, a pulse output unit utilized to generate a pulse of the best warm-up frequency and the best light emitting frequency, a transistor oscillator used to drive and control the pulse output unit to output the pulses of the best warm-up frequency and the best light emitting frequency, and a source of electricity connected with the pulse output unit and light emitter that is used to receive the pulses of the best warm-up frequency and the best light emitting frequency from the pulse output unit in order to generate the electricity supply voltage of the best warm-up frequency or the best light emitting frequency to become the output voltage of the light emitter.

The electric power supply unit further comprises a voltage input unit, switch unit and transformer. The on/off switch is controlled by the pulses of the best warm-up frequency and the best light emitting frequency in order to switch on and off the connection between the voltage unit and transformer to form the output of the working voltage.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DETAILED DESCRIPTION OF THE PREFERRED EMBODIMENT

Figure 1:
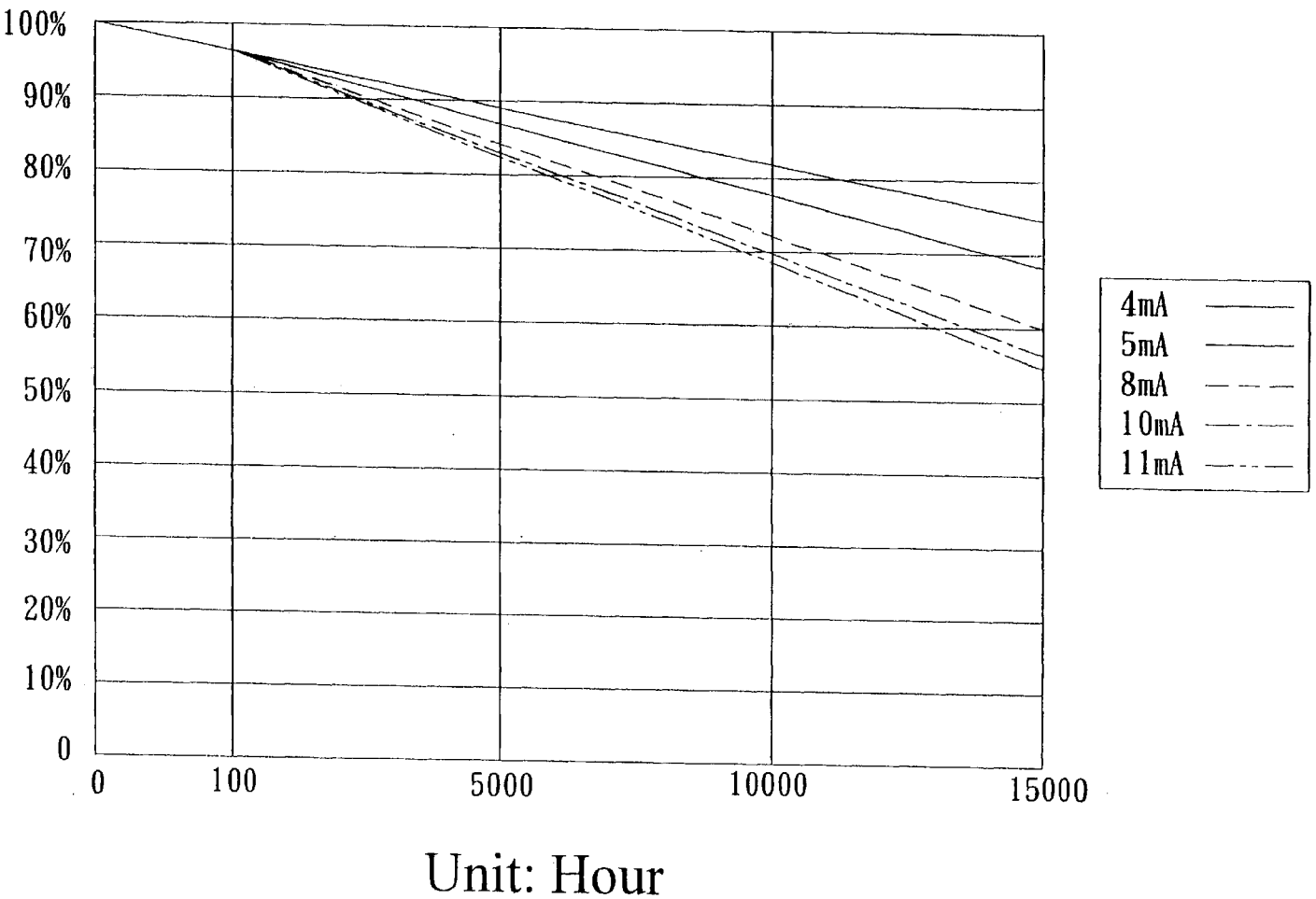
FIG. 1 is a graph showing a lamp life with different currents at 25 degrees centigrade.
Figure 2:
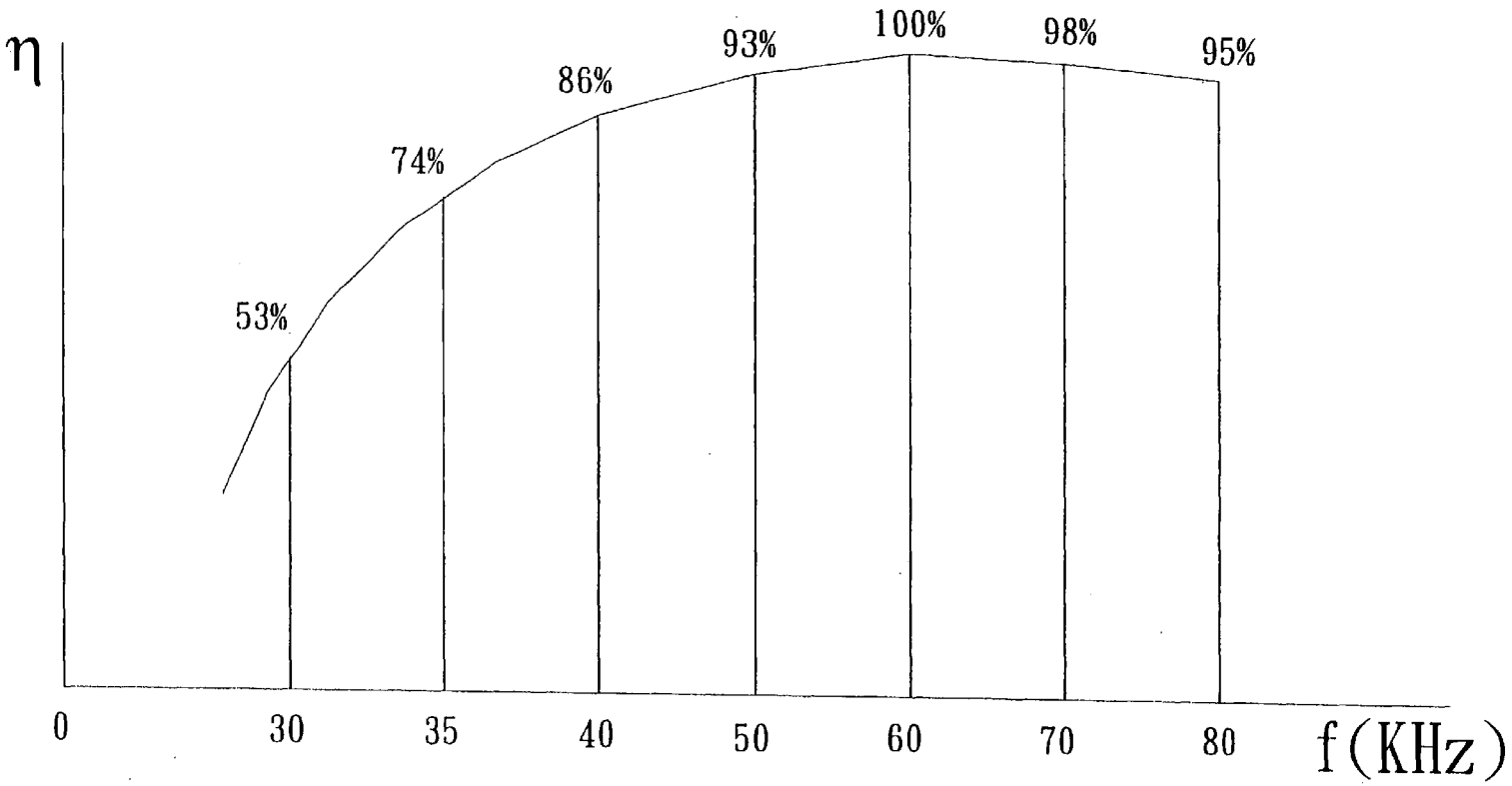
FIG. 2 is a graph showing illumination efficiency at a frequency of 60 kHz for a cold cathode fluorescent lamp with a length of 250 mm and an outer diameter of 2.6 mm.

A cold cathode fluorescent lamp with a length of 250 mm and an outer diameter of 2.6 mm is used as an illuminator in a preferred embodiment of the invention. FIG. 2 shows an illumination efficiency curve of the cold cathode fluorescent lamp at the frequency of 60 kHz, wherein $\eta$ is the illumination efficiency constant. As FIG. 2 shows, the illumination efficiency of the cold cathode fluorescent lamp is highest at 60 kHz, and the efficiency at 30 kHz is only 53 percent thereof. Similarly, a lower efficiency also occurs at a frequency higher than 60 kHz. The higher the frequency, the lower the efficiency.

Now, supposing that the resistance of the cold cathode fluorescent lamp is R1. The consumed energy is then I*I*R1 at a regular current, such as I mA. This consumed energy can be transformed into two energy forms according to the law of the conservation of energy: one is light and the other is heat. Therefore, the energy consumed by the cold cathode fluorescent lamp at different power supply frequencies is either more light and less heat, or less light and more heat.

The different light and heat transformation effects yielded at the different power supply frequencies mentioned above is used in the invention to attain the fast warm-up of the cold cathode fluorescent lamp. And, the fast warm-up of the lamp can be attained at a fixed regular current, such as 5 mA and below, and needs no large current.

Therefore, the best illumination frequency and the best warm-up frequency can be found with a light and heat effect curve graph, and only the fixed lamp length and outer diameter of the cold cathode fluorescent lamp need to be checked beforehand. The warm-up of the lamp can be achieved in a short time at the best warm-up power supply frequency. The best illumination efficiency can be attained at the best illumination power supply frequency, and stable illumination can be obtained for the scanner. As to the warm-up time, it can be obtained by calculating energy transformation values.

From the above description, it is clear that the lamp can be warmed through utilizing the heat emitted by the lamp itself in quite a short time. This is done by limiting the power supply frequency at the lamp warm-up time to the best warm-up frequency, and limiting the power supply frequency for the lamp working period to the best illumination frequency.

The following description stresses the generating of a stable power supply in the invention, while controlling the power supply frequency for the different periods (the warm-up and working periods).

First, a stable power supply can be obtained through the control of the output method of the input power supply source. The pulse source needed for the power supply source can be obtained from the pins of the ASIC on the scanner. The oscillating frequency of the ASIC is very stable and does not float because its frequency is yielded from a crystal oscillator and not from a usual RC or RL circuit. Thereby, combining the stable power voltage source (fixed voltage) and the pulse source can achieve the purpose of yielding power supply. This also means that it can obtain the power supply of the best warm-up frequency and the power supply of the best illumination frequency.

The warm-up time needed for the cold cathode fluorescent lamp at the best warm-up frequency is T. This can be obtained according to the result calculated from the light and heat transformation mentioned above. It only needs to supply the pulse of the best warm-up frequency for the warm-up time T period, and to supply the pulse of the best illumination frequency after time T. The invention only needs to set the required warm-up time T in a driver program, and control the output of the pins of the ASIC to be the best warm-up frequency output for the warm-up time T period and the best illumination frequency output after time T.

Figure 3:
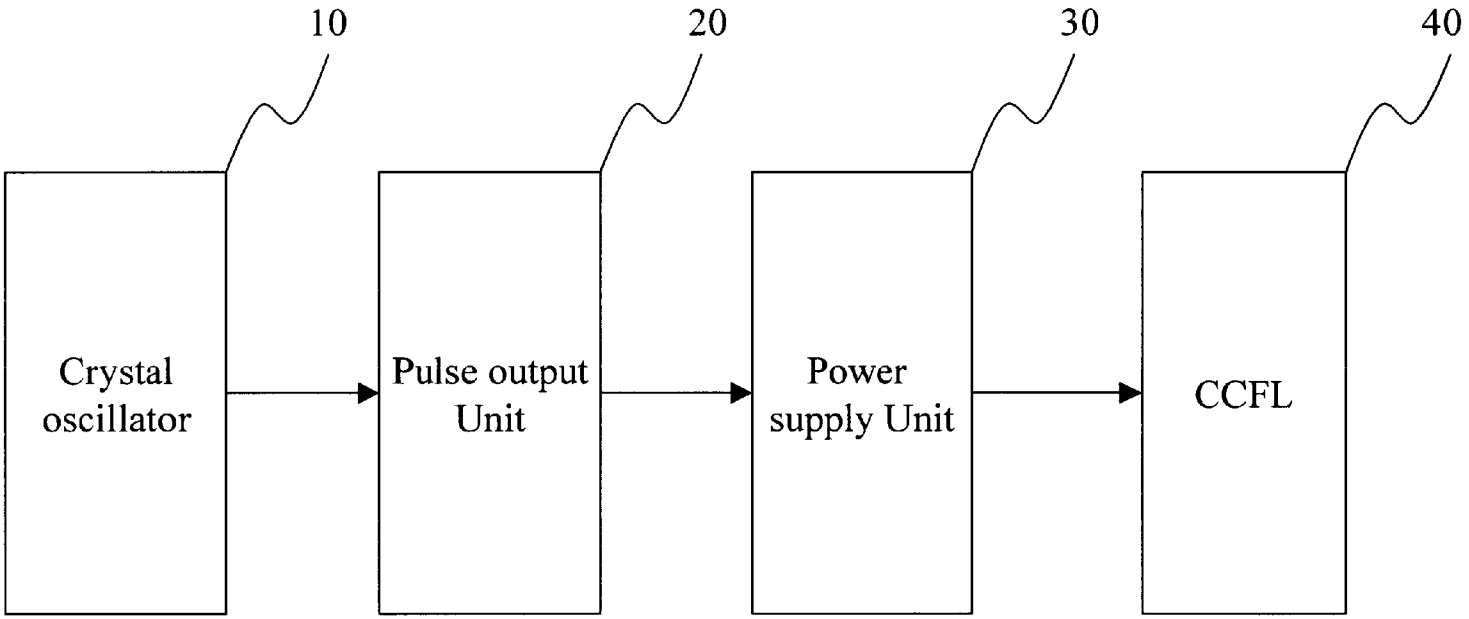
FIG. 3 is a block diagram showing constructing elements of the illuminating device according to the invention.

Please refer to FIG. 3, which shows the function block diagram of the illumination device of a preferred embodiment according to the invention. It comprises a crystal oscillator 10, a pulse output unit (ASIC) 20, a power supply unit 30 and a cold cathode fluorescent lamp 40 according to the working principle design mentioned above. The crystal oscillator 10 provides a stable oscillating frequency (MHz). The pulse output unit 20 lowers the oscillating frequency to generate the best warm-up frequency (kHz) and the best working frequency (kHz) needed for the invention. The power supply unit 30 switches the power output according to the best warm-up pulse or the best working pulse input from the pulse output unit 20, to heat the cold cathode fluorescent lamp quickly with the power supply at the best warm-up frequency (less light is emitted at the same time). The lamp is then illuminated at the best illumination frequency (less heat is dissipated at the same time).

The power supply unit 30 comprises a voltage supply unit, switch and transformer. The voltage supply unit is 12 voltages alternated voltage input. It controls the on/off switch by receiving the pulse yielded from the pulse output unit 20 to turn on or off the connection between the voltage supply unit and the transformer. A power supply voltage synchronized with the pulse source frequency can be formed through the output of the transformer; and the voltage tuned up through the transformer can become the driving voltage for activating the cold cathode fluorescent lamp 40.

As a result, the pulse output unit 20 (ASIC) outputs the preset best warm-up frequency immediately and begins to calculate by time T when a user pushes the scanner operation button, i.e. when a scanning command is sent out and the pulse output unit 20 receives this scanning command. The preset illumination frequency is output after time T. Please refer to FIG. 2, which shows that the illumination efficiency is highest at 60 kHz; the best illumination frequency can be set at 60 kHz. And, 30 kHz can be set to be the best warm-up frequency, being the half of 60 kHz. Or, the best illumination frequency can be set to be 60 kHz and the best warm-up frequency to be 30 kHz. Further description will be provided as follows.

Figure 4:
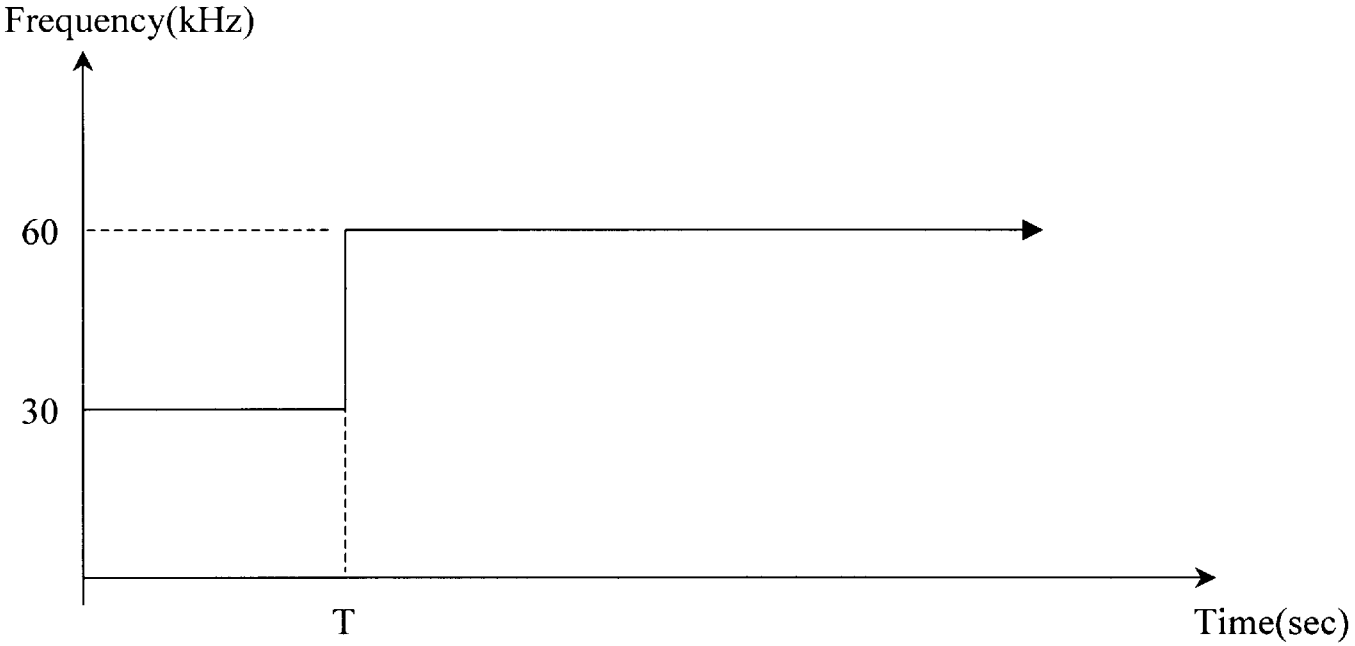
FIG. 4 is a graph showing a frequency curve for power supply according to the invention.

Please refer to FIG. 4, which shows a power supply frequency curve graph. As shown in the curve graph, it only needs to let the pulse source, i.e. the pulse output unit 20 in FIG. 3, to provide a pulse of 30 kHz for the scanner warm-up time period T. Thereafter, the pulse of 60 kHz is provided so that fast warm-up can be attained.

Figure 5:
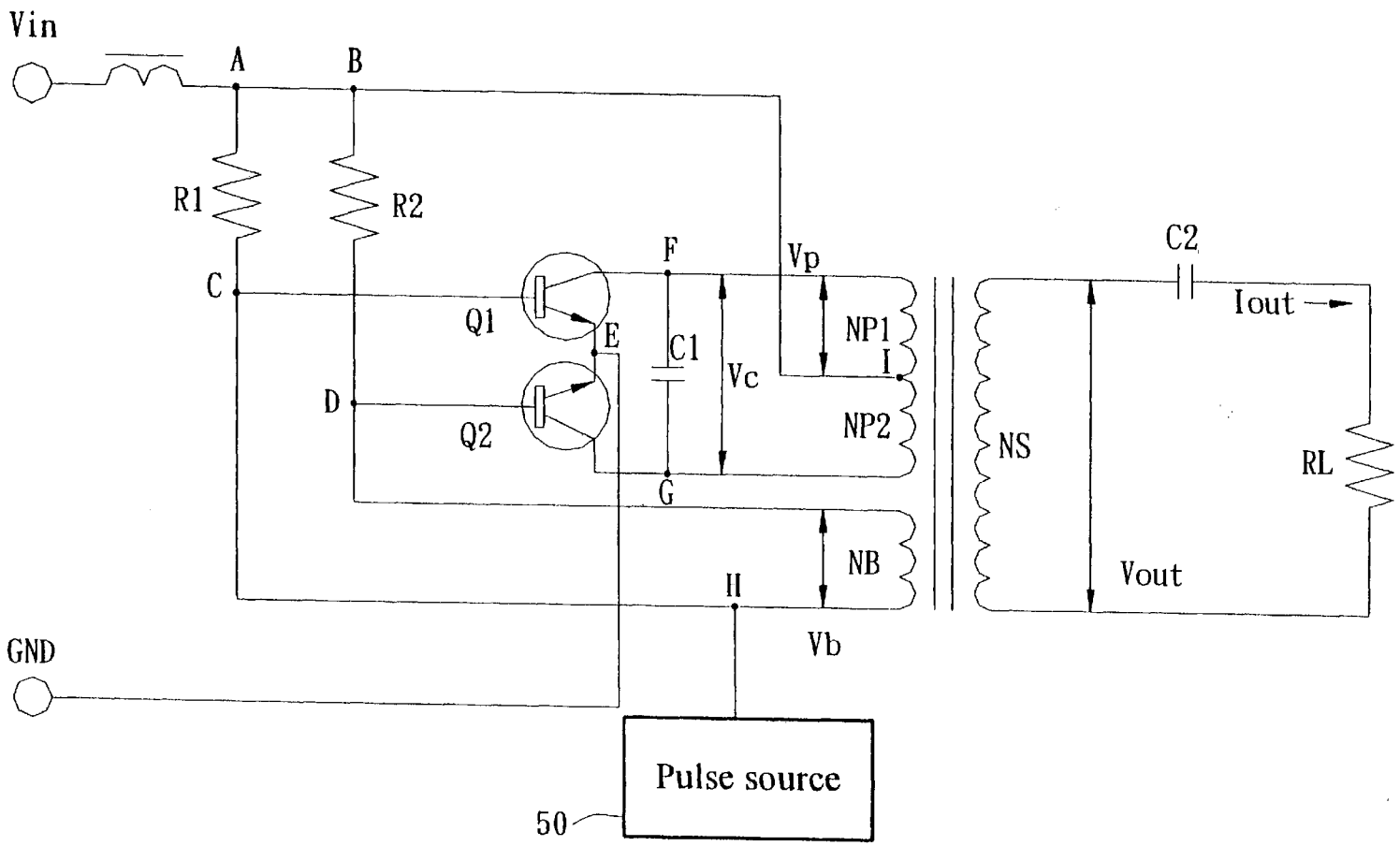
FIG. 5 is a circuit plot for a power supply unit according to the invention.

Finally, please refer to FIG. 5. This figure shows the circuit of the power supply unit 30, and it clearly illustrates how to generate a power supply in the invention.

As FIG. 5 shows, the output of the pulse source 50 (i.e. ASIC) is connected to an end point H, an end point C, which is connected with a resistor R1 and the base of a transistor Q1, and to an end of a coil NB. Another end A of R1 is connected to the input voltage Vin of the power source; this end is taken as the common input end 1 of coils NP1 and NP2, and the connecting end B of a resistor R2. Another end of the coil NB is connected with the base of a second transistor Q2 and another end of the resistor R2 to an end D. The emitters of the transistor Q1 and Q2 are connected to an end E together, and connected to the ground end GND. The collector of the transistor Q1 is connected to another end of the coil NP1 through an end F, and the collector of the transistor Q2 is connected to another end of the coil NP2 through an end G. Both are parallel to a capacitor C1 at the ends F and G. A coil NS of the output end is in series with a capacitor C2, and the cold cathode fluorescent lamp is represented as the resistor R1.

As can be clearly seen from FIG. 5, the pulse of the pulse source 50 is output to the base of the transistor Q1, and the voltage between the end C and end E is changed together with the voltage of the pulse source 50. Therefore, the transistor Q1 is formed to open and close together with the pulse change of the pulse source 50. Because the transistors Q1 and Q2 are arranged symmetrically, and the coils NP1 and NP2 are also arranged symmetrically, the symmetry is destroyed when the output of the pulse source 50 is a high voltage standard, so as to make the voltages at the end F and end G different. That is, the working voltage Vc passes through the coils NP1/NP2 and the coil NS and is transformed to output voltage Vout. When the output of the pulse source 50 is a low voltage standard (normally it is zero), the working voltage Vc is also zero. Owing to the symmetrical structure thereof, the output voltage Vout is zero.

In other words, the pulse of the pulse source 50 lets the transistors Q1 and Q2 become a switch, and the input Vin is transformed to the working voltage passing through the switch when it is input into the end C. Therefore, the output voltage of the power supply voltage synchronized with the pulse source 50 can be obtained when Vc is transformed via the transformer. Besides, a capacitor C2 can stabilize the output voltage Vout.

The fast warm-up of the illuminator (the fastest warm-up may reach 5 seconds) can be obtained only by controlling the pulse frequency of the pulse source if the circuit is simple and only one fixed input voltage is needed.

The method for activating an illuminator and illumination device according to the invention can save manufacturing expenses owing to its simple circuit, and can increase the life span of the lamp owing to its smaller activating current (approximately 8 mA) and lower temperature during regular work.

Besides, using the method for activating an illuminator and illumination device according to the invention, can be completely synchronized with the exposure time of the CCD, and is not influenced by frequency floatation.

It is noted that the method for activating an illuminator and illumination device of the invention is described for the purpose of illustration only, and is not intended as a definition of the limits and scope of the invention disclosed. Any modifications and variations that may be apparent to a person skilled in the art are intended to be included within the scope of the following claims.

What is claimed is:

1. A method for activating illuminator, using a fixed voltage source of said illuminator, comprising:

measuring frequency and light efficiency response curve of said illuminator for determining the best illumination frequency, the best warm-up frequency and a warm-up time of said illuminator;

providing a double frequencies control unit for controlling the output frequency of said fixed voltage source, supplying said illuminator with said fixed voltage source of the best warm-up frequency when said illuminator is operated; and supplying said illuminator with said fixed voltage source of the best illumination frequency by said double frequencies control circuit after said warm-up time is passed.

2. The method of claim 1, wherein said illuminator is a cold cathode fluorescent lamp (CCFL).

3. The method of claim 1, wherein said best warm-up frequency is 30 kHz and said best illumination frequency is 60 kHz.

4. The method of claim 1, a pulse source needed for said fixed voltage source coming from pulses output from pins of an ASIC.

5. The method of claim 1, wherein said double frequencies control unit sends out a warm-up frequency control command to said fixed voltage source after receiving an activating signal, said fixed voltage source outputs the voltage of the best warm-up frequency, and said double frequencies sends a working frequency control command to said fixed voltage source to output the fixed voltage of the best illumination frequency after said warm-up time is passed.

6. The method of claim 1, wherein the best illumination frequency is the output frequency of said voltage source when light efficiency is highest at measured frequencies, and the best warm-up frequency is the output frequency of said voltage source when said light efficiency is little lower at said measured frequencies.

7. The method of claim 6, wherein said warm-up time is a time length needed for the energy output from said fixed voltage source to be transformed to the heat needed for warming said illuminator up according to the light efficiency of the best warm-up frequency.

8. An illumination device, comprising:

an illuminator, for receiving an output voltage to emit light;

a crystal oscillator, for generating the pulse of an oscillating frequency;

a pulse output unit, for adjusting the pulse of said oscillating frequency to generate the pulses of the best warm-up frequency and the best illumination frequency; and a power supply unit connected with said pulse output unit and said illuminator, for receiving the pulse of the best warm-up frequency or the best illumination frequency of said pulse output unit to generate a power supply voltage of the best warm-up frequency or a power supply voltage of the best illumination frequency for using as an output voltage of said illuminator;

the pulse output unit outputs the best warm-up frequency to said power supply unit after receiving an activating signal; said pulse output unit outputs the best illumination frequency to said power supply unit after a warm-up time.

9. The device of claim 8, wherein said illuminator is a cold cathode fluorescent lamp (CCFL).

10. The device of claim 8, wherein the best illumination frequency is the output frequency of said voltage source when light efficiency is highest at measured frequencies, and the best warm-up frequency is the output frequency of said voltage source when said light efficiency is little lower at said measured frequencies.

11. The device of claim 8, wherein said best warm-up frequency is 30 kHz and said best illumination frequency is 60 kHz.

12. The device of claim 8, wherein said pulse output unit is an ASIC.

13. The device of claim 8, wherein said warm-up time is a time length needed for the energy output from said fixed voltage source to be transformed to the heat needed for warming said illuminator up according to the light efficiency of the best warm-up frequency.

14. The device of claim 8, wherein said power supply unit includes a voltage input unit, switch and transformer, and the switching of the switch is controlled by the pulse of the warm-up frequency or the best illumination frequency to switch the connection between said voltage input unit and transformer to form the output of said working voltage.

15. The device of claim 14, wherein said voltage input unit is a 12 volts alternating voltage input.

16. An illumination device, comprising:

an illuminator, for receiving an output voltage to emit light;

a crystal oscillator, for generating the pulse of an oscillating frequency;

a pulse output unit, for adjusting the pulse of said oscillating frequency to generate the pulses of the best warm-up frequency and the best illumination frequency; and a power supply unit connected with said pulse output unit and said illuminator, for receiving the pulse of the best warm-up frequency or the best illumination frequency of said pulse output unit to generate a power supply voltage of the best warm-up frequency or a power supply voltage of the best illumination frequency for using as an output voltage of said illuminator;

wherein said power supply unit includes a voltage input unit, switch and transformer, and the switching of the switch is controlled by the pulse of the warm-up frequency or the best illumination frequency to switch the connection between said voltage input unit and transformer to form the output of said working voltage.

17. The device of claim 16, wherein said voltage input unit is a 12 volts alternating voltage input.

18. The device of claim 16, wherein said illuminator is a cold cathode fluorescent lamp (CCFL).

19. The device of claim 16, wherein the best illumination frequency is the output frequency of said voltage source when light efficiency is highest at measured frequencies, and the best warm-up frequency is the output frequency of said voltage source when said light efficiency is little lower at said measured frequencies.

20. The device of claim 16, wherein said best warm-up frequency is 30 kHz and said best illumination frequency is 60 kHz.

* * * * *